US008596304B2

(12) United States Patent
Gerth et al.

(10) Patent No.: US 8,596,304 B2
(45) Date of Patent: Dec. 3, 2013

(54) LENO DEVICE WITH LINKAGE MECHANISM AND COVER PART

(75) Inventors: Christian Gerth, Albstadt (DE); Stefan Kailer, Mebstetten (DE); Bernd Dietrich, Trochtelfingen-Wilsingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 13/486,420

(22) Filed: Jun. 1, 2012

(65) Prior Publication Data

US 2012/0305124 A1 Dec. 6, 2012

(30) Foreign Application Priority Data

Jun. 1, 2011 (EP) ..... 11168473

(51) Int. Cl.
*D03C 7/00* (2006.01)
*D03C 7/08* (2006.01)
*D03C 13/00* (2006.01)

(52) U.S. Cl.
USPC ..... 139/50; 139/35; 139/55.1

(58) Field of Classification Search
USPC ..... 139/35, 50, 55.1
See application file for complete search history.

(56) References Cited

U.S. PATENT DOCUMENTS

| | | | | |
|---|---|---|---|---|
| 4,275,515 | A * | 6/1981 | Hinson | 38/102.91 |
| 5,524,678 | A * | 6/1996 | Haeussler et al. | 139/54 |
| 7,032,624 | B2 * | 4/2006 | Bruske et al. | 139/57 |
| 7,287,553 | B2 * | 10/2007 | Wahhoud | 139/50 |
| 7,617,844 | B2 * | 11/2009 | Schwane et al. | 139/91 |
| 7,918,249 | B2 | 4/2011 | Moser | |
| 2005/0016612 | A1 * | 1/2005 | Manthey et al. | 139/93 |
| 2005/0051228 | A1 * | 3/2005 | Bruske et al. | 139/55.1 |
| 2005/0061385 | A1 * | 3/2005 | Gesing | 139/91 |
| 2005/0081942 | A1 * | 4/2005 | Schwane et al. | 139/92 |
| 2007/0062596 | A1 * | 3/2007 | Mettler | 139/82 |
| 2007/0125131 | A1 * | 6/2007 | Stingel | 66/168 |
| 2008/0034803 | A1 * | 2/2008 | Weihing | 66/8 |
| 2009/0139580 | A1 * | 6/2009 | Moser | 137/50 |
| 2012/0305124 | A1 * | 12/2012 | Gerth et al. | 139/54 |

FOREIGN PATENT DOCUMENTS

| | | | | |
|---|---|---|---|---|
| BE | 1017580 | A3 | 1/2009 | |
| EP | 2063007 | B1 | 9/2010 | |
| EP | 2530194 | * | 1/2011 | D03C 7/00 |
| JP | 2004300637 | A | 10/2004 | |

OTHER PUBLICATIONS

European Search Report; EP11168473.4 dated Oct. 21, 2011; 4 pgs.

* cited by examiner

*Primary Examiner* — Bobby Muromoto, Jr.
(74) *Attorney, Agent, or Firm* — Fitch, Even, Tabin & Flannery LLP

(57) ABSTRACT

A leno device for use in weaving machines. The leno device having a first lifting shaft, a second lifting shaft and a half shaft. The shafts are connected with each other via a linkage mechanism having several transmission units Each transmission unit having a connecting bar and two guide rods. In order to prevent fingers and or the hand of the operator from being pinched between the connecting bar and one of the levers, the leno device has a separate cover part for each transmission unit. The cover part may be fastened to one of the lifting shafts or to one of the guide rods of the transmission unit, or to the connecting bar. The cover part prevents an operator from being able to reach between the connecting bar and the guide rods in warp thread direction.

13 Claims, 8 Drawing Sheets

LENO DEVICE WITH LINKAGE MECHANISM AND COVER PART

RELATED APPLICATIONS

This application claims the benefit of European Patent Application No. 11168473.4, filed Jun. 1, 2011, the contents of which are fully incorporated herein by reference.

BACKGROUND

The present invention relates to a leno device such as is used for the manufacture of leno fabrics. A leno fabric is a fabric wherein at least two warp threads are not moving parallel next to each other but intertwine with each other. For example, a warp thread moves as the ground thread in a straight direction through the fabric, while another warp thread is guided as the a loop thread over and under the ground thread in a back and forth manner and alternately forms—on the one or the other side—a downwardly or upwardly directed loop for the accommodation of the warp thread.

A leno device has been known from publication EP 2 063 007 B1. The leno device comprises two lifting shafts that are supported so as to be vertically shiftable, each of said lifting shafts carrying lifting healds. Additionally present is a is a half shaft that is supported so as to be vertically shiftable relative to the lifting shafts, said half shaft carrying half healds. A linkage mechanism connects the half shaft with at least one of the lifting shafts. The linkage mechanism comprises a connecting bar connected with the half shaft on a connecting bar joint and comprises a guide rod connected with the connecting bar on a coupling joint and with the lifting shaft on a shaft joint.

When the leno device is being operated, an intermediate space is opened and closed again between the guide rod and the connecting bar. This is a function of the position of the two lifting shafts. In order to ensure the operational safety of such a leno device monitoring devices, for example light barriers, were mounted to the weaving machine. If an operator reaches into the moving space of the lifting shafts the weaving machine is instantly stopped. Otherwise, considering the high speed of the lifting shafts, injuries may occur if a hand or fingers enter the intermediate space between the connecting bar and the guide rod, said intermediate space subsequently closing again.

However, there is the problem that the shutdown of the weaving machine does not result in the instant stopping of the lifting shafts but that a certain subsequent additional movement of the lifting shafts inevitably exists. In addition, such monitoring devices are complex and expensive.

Therefore, it may be viewed as the object of the present invention that the mentioned disadvantages be eliminated and a leno device be produced, said leno device ensuring greater operational safety.

SUMMARY

This object is achieved with a leno device displaying the features of the invention disclosed herein. The leno device comprises a cover part that may be configured, for example, as a flat plate. The cover part may be fastened to one of the lifting shafts or to a part of the linkage mechanism, for example to the guide rod or to the connecting bar. It is also possible for the cover part to be represented by the connecting bar itself, so that the cover part and the connecting bar consist of the same material and transition into each other without seams or disconnects. The cover part has a size and a contour that completely, or at least partially, covers the intermediate space between the connecting bar and the guide rod in any position of the two lifting shafts so that reaching through the intermediate space in a warp thread direction oriented transversely to the plane of extension of the lifting shaft is not possible. The cover part moves together with the leno device. Indeed, this increases the mass to be accelerated; however, greater flexibility is achieved in this manner. The leno device can be used in any weaving machine without requiring a retrofitting of additional safety measures.

It is of advantage if the connecting bar is connected with the first lifting shaft via a first guide rod and with the second lifting shaft via a second guide rod. As a result of this, the position of the connecting bar, and thus the half shaft, is determined by the relative position of the two lifting shafts. In doing so, the two shaft joints of the two guide rods may be arranged at a distance from each other in the longitudinal direction of extension of the lifting shafts.

Considering one exemplary embodiment, the cover part is fastened to the shaft rod in the region of the shaft joint of one of the two lifting shafts. In doing so, the cover part covers—viewed in warp thread direction transverse to the plane of extension of the lifting shaft—the linkage mechanism located behind in any position of the two lifting shafts.

The cover part may be configured so as to be asymmetrical relative to a center line. The center line may extent in vertical direction, for example, when the cover part is fastened to the lifting shaft. In this embodiment, the cover part always moves with one of the lifting shafts so that said cover part assumes various relative positions in the two end positions of the lifting shafts at a maximum distance relative to the linkage mechanism. The asymmetrical form ensures a minimal size of the cover part and still ensures a reliable covering of the intermediate space or the intermediate spaces between a respective guide rod and the connecting bar.

In all exemplary embodiments, the length of the cover part—viewed in the direction of longitudinal extension of the shaft rods of the lifting shafts—is preferably greater than the distance between the two shaft joints. The height of the cover part, measured in vertical direction, may be greater, in particular, than the distance of the connecting bar joint from the two lifting shafts when the two lifting shafts assume the same vertical position.

In another embodiment, the cover part may be non-torsionally connected to a guide rod of the linkage mechanism. In particular, the cover part may have a shape resembling the sector of a circle. In doing so, the center of the arc of the circle of the sector of the circle is located close to the shaft joint connected to the guide rod.

In another preferred embodiment, the cover part is mounted to the connecting bar. Preferably, the connecting bar consists of a stable material such as, for example, carbon, or of a metal such as, for example, steel, or of a composite material. The connecting bar displays sufficient flexural strength and resistance to buckling. Via the connecting bar, it must be possible to transmit a force between the lifting shafts and of the half shaft. Due to the high acceleration of the lifting shafts and the half shaft, the connecting bar must ensure sufficient stability. The cover part that is fastened to the connecting bar may be made of another material, for example a plastic material or composite material, said material having a density that is lower than the density of the connecting bar material. As a result of this, a small total mass is obtained. Preferably, the cover part extends in a plane that is oriented parallel to the plane of extension of the lifting shafts. The cover part may have the form of a plate. The cover part that is connected to the connecting bar is located, in particular, between the two guide rods. Because of the cover part, it is not possible to reach through the intermediate space between the connecting bar and one of the guide rods.

The cover part may also be provided as a retrofittable part for retrofitting a known leno device.

In all the mentioned diverse embodiments, the cover part has rounded corners and/or rounded edges at least on its upper side, so that sharp edges presenting a great risk of injury during the upward movement of the cover part are avoided.

In order to reduce weight, the cover part may have a plurality of perforations. The form and/or area of these perforations is selected in such a manner that it is not possible to reach through with a finger.

Furthermore, it is possible for the cover part to consist, at least in part, of a net-like or mesh-like region. For example, the cover part may have a frame structure in which a net material or mesh material is held, for example a woven or knit material, for example a textile material or also a wire mesh.

The described diverse embodiments can also be combined with each other. The inventive leno device that is equipped with the cover part is provided in a weaving machine comprising several such leno devices, at least in feeding direction of the warp thread at the frontmost and/or at the rearmost point. Leno devices arranged in between can also be embodied without a cover part.

Advantageous embodiments of the invention result from the disclosed claim limitations, as well as from the description. The description explains the invention with reference to exemplary embodiments. The description is restricted to essential features of the exemplary embodiments and to miscellaneous facts. The drawings are intended as a supplementary reference.

DETAILED DESCRIPTION

Figure 1:
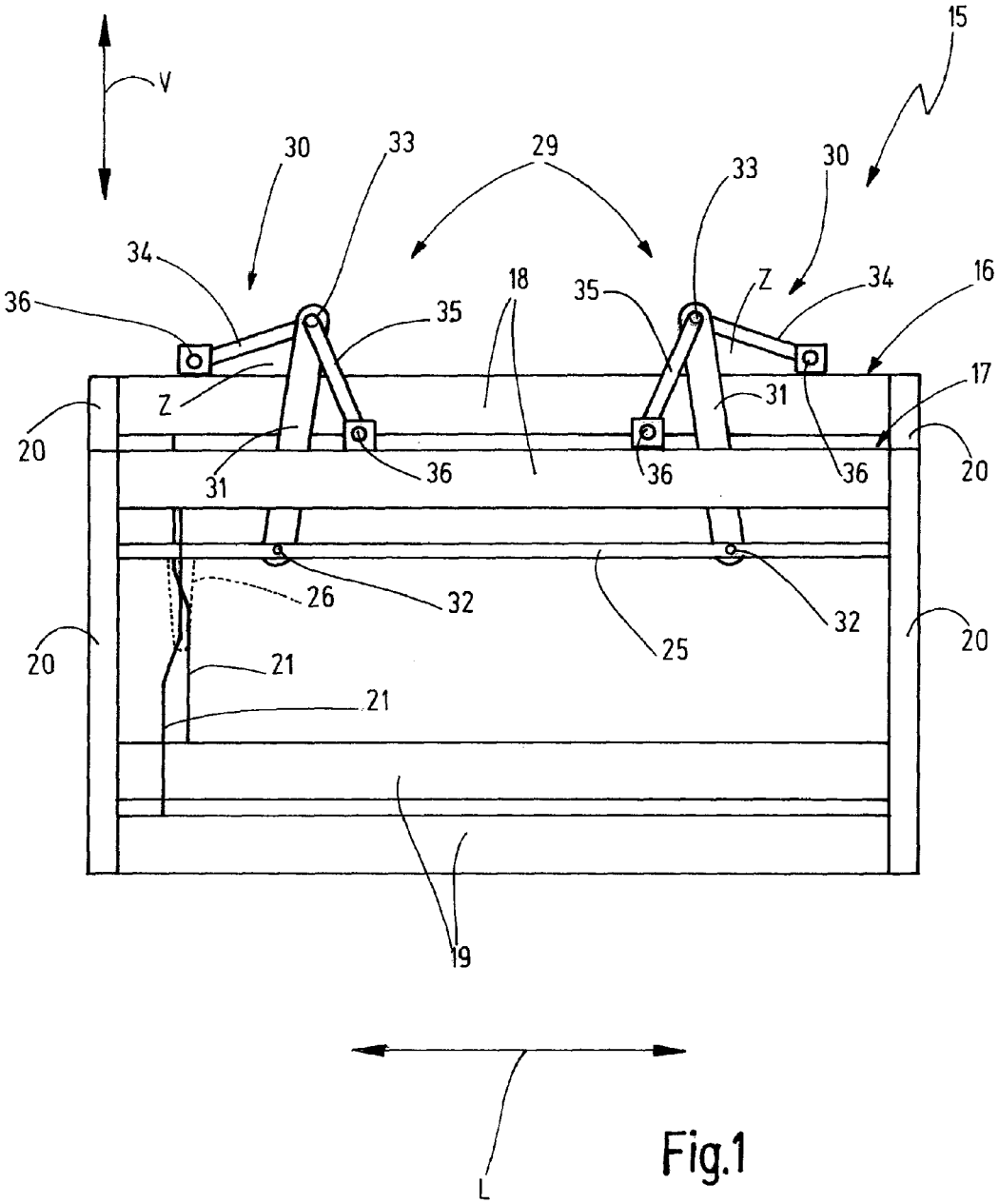
FIG. 1 a lateral view of a schematic representation of a prior-art leno device, in warp thread direction transverse to the plane of extension of the lifting shafts.

FIG. 1 is a schematic representation of a known leno device 15. The leno device 15 comprises a first lifting shaft 16 and a second lifting shaft 17. The two lifting shafts 16, 17 are identically configured and each has an upper shaft rod 18 and a lower shaft rod 19, these being aligned in the direction of longitudinal extension L. The upper shaft rod 18 and the lower shaft rod 19 of a lifting shaft 16, 17 are connected to each other on the two lower longitudinal ends by means of respectively one lateral support. The lateral supports 20 extend in the direction of movement of the lifting shafts 16, 17 and thus in vertical direction V. The two lifting shafts 16, 17 can be moved independently of each other in vertical direction V. This is accomplished with a not illustrated shaft drive of a weaving machine.

Lifting healds 21 are arranged on the not illustrated heald support rails of the lifting shafts 16, 17. Each lifting shaft 16, 17 carries a plurality of lifting healds 21 with respectively only one lifting heald 21 being shown as an example in FIG. 1 in order to avoid confusion.

Furthermore, the leno device 15 comprises a half shaft 25 with half healds 26 arranged thereon. The number of half healds 26 corresponds to the number of lifting healds 21 that are carried by respectively one of the two lifting shafts 16, 17. In the course of the production of the leno fabric the half heald 26 interacts with respectively one lifting heald 21 of one of the two lifting shafts 16, 17.

In order to produce the relative movement between the half shaft 25 and the two lifting shafts 16, 17 in vertical direction V, a linkage mechanism 29 is provided in accordance with the example. The linkage mechanism 29 couples the two lifting shafts 16, 17 with the half shaft 25. Due to the vertical shifting motion of the two lifting shafts 16, 17, a vertical movement of the half shaft 25 is produced caused via the linkage mechanism 29.

In the exemplary embodiment, the linkage mechanism 29 comprises two transmission units 30. Depending on the length of the lifting shafts in the direction of longitudinal extension L, it is also possible for more than two transmission units 30 to be provided. The design of the transmission units 30 is identical. Each transmission unit 30 comprises a connecting bar 31 that is pin-connected with the half shaft 25 via a connecting bar joint 32. On its end opposite the connecting bar joint 32, the connecting bar 31 is connected—via a coupling joint 33—to a first guide rod 34 and a second guide rod 35. On its end opposite the coupling joint 33, the first guide rod 34 is connected—via a shaft joint 36—to the upper shaft rod 18 of the first lifting shaft 16. On its end opposite the coupling joint 33, the second guide rod 35 is connected—via a shaft joint 36—to the upper shaft rod 18 of the second lifting shaft 17. This design is identical in all transmission units 30.

Considering a modification of the exemplary embodiment, the transmission units 30 may also be connected to the lower shaft rods 19 of the lifting shafts 16, 17 and may thus be located on the underside of the lifting shafts 16, 17.

Figure 2:
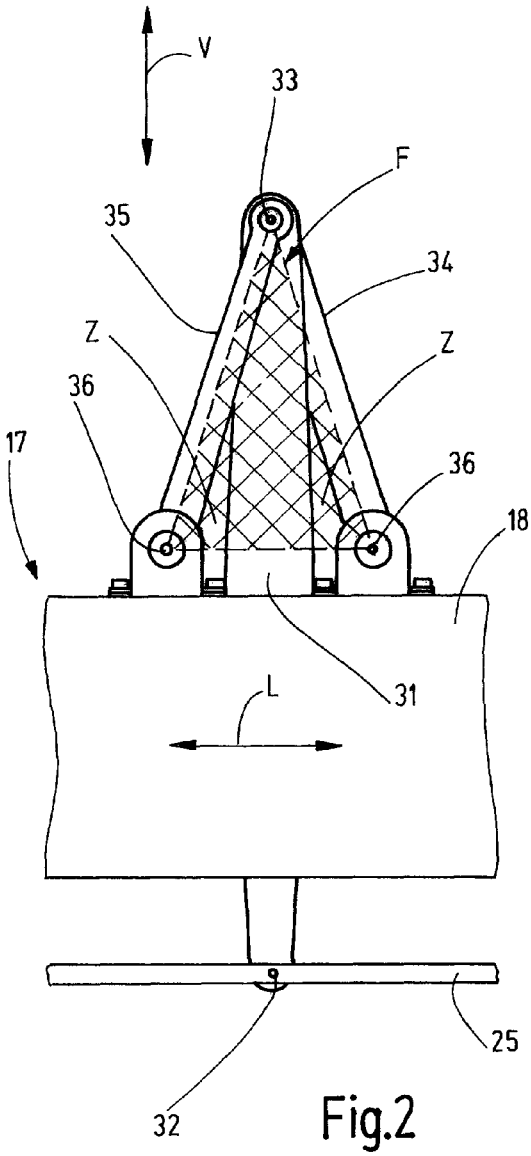
FIGS. 2 and 3 the linkage mechanism of the leno device as in FIG. 1, in various relative positions of the two lifting shafts, in different viewing directions in warp thread direction.
Figure 3:
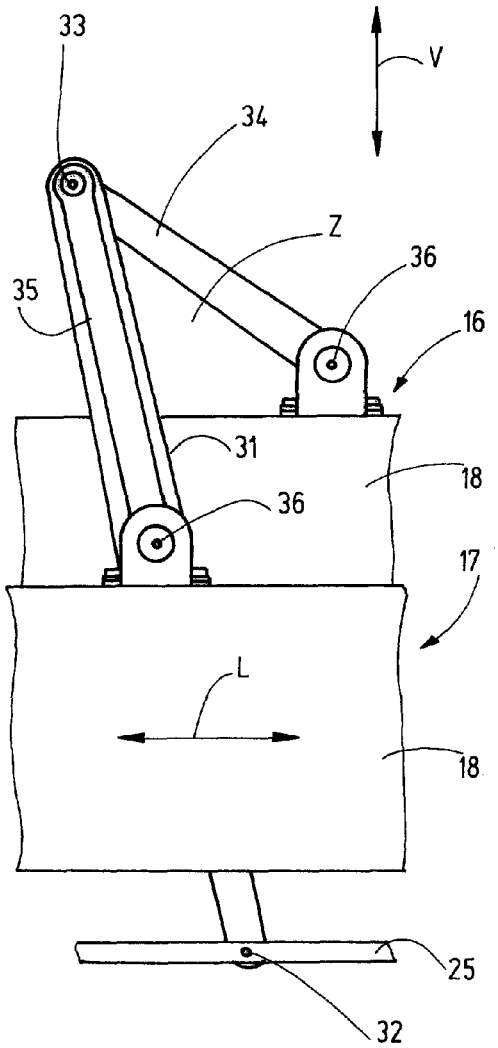

In the direction of longitudinal extension L of the shaft rods 18, 19, the two shaft joints 36 of a transmission unit 30 are arranged at a distance from each other. Between the coupling joint 33 and the two shaft joints 36, there is located a triangular area F, said area being schematically indicated by cross-hatching in FIG. 2. In the region of this area F, an intermediate space Z may be formed between the connecting bar 31 and the first guide rod 34 and/or the second guide rod 35. As a function of the position of the two lifting shafts 16, 17, this intermediate space Z can be opened or made larger, and in the case of the reverse relative movement between the two lifting shafts 16, 17, can also be made smaller or be closed. This is shown in an exemplary manner by FIGS. 2 and 3. In FIG. 2, the two lifting shafts 16, 17 are arranged on the same level in vertical direction V. The connecting bar 31 essentially extends in vertical direction V. The two guide rods 34, 35 extend diagonally with respect to the vertical direction V and diagonally with respect to the longitudinal direction L in a plane defined by the vertical direction V and the longitudinal direction L. If now the second lifting shaft 17 is lowered relative to the first lifting shaft 16 in vertical direction V, said second shaft may assume the position shown in FIG. 3. In doing so, the intermediate space Z between the second guide rod 35 and the connecting bar 31 has disappeared completely. The connecting bar 31 and the second guide rod 35 extend essentially in the same direction. The inadvertent intervention in such an intermediate space Z can result in injury to a finger or the hand of the operator.

Therefore, in accordance with the invention, a cover part 40 is provided, said cover part completely covering the intermediate space Z between the connecting bar 31 and the two guide rods 33, 34 of a transmission unit 30 in any relative position of the two lifting shafts 16, 17. Here, complete coverage is understood to mean that reaching with a finger or a hand through the intermediate space Z between the connecting bar 31 and the first guide rod 34 or the second guide rod 35 in a warp thread direction K is prevented. The warp thread direction K extends transversely to the vertical direction V and transversely to the direction of longitudinal extension L and, in FIGS. 1 to 8 and 10 and 11, transversely to the plane of projection. Hereinafter, different exemplary embodiments of the cover part 40 will be described. These cover parts 40 are used in a leno device 15 as in FIGS. 1 through 3 in order to increase operational safety.

Figure 4:
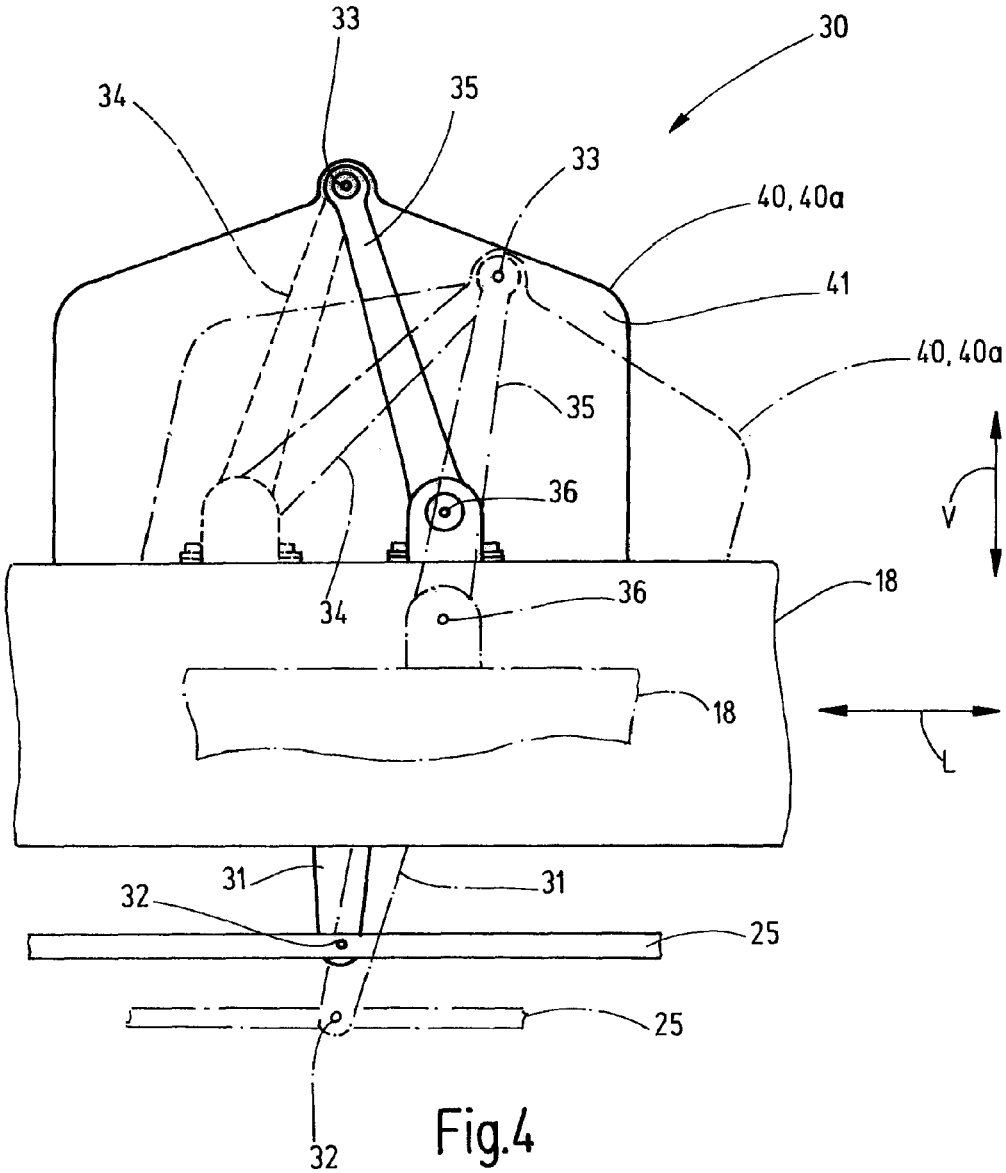
FIG. 4 a schematic representation of a first exemplary embodiment of an inventive cover part for the leno device.

FIG. 4 shows an exemplary embodiment of a cover part 40, said cover part being referred to as the first cover part 40*a*. The first cover part 40*a* is fastened to the connecting bar 31 and extends in both directions—starting from the connecting line—between the connecting bar joint 32 and the coupling joint 33. The first cover part 40*a* has the shape of a plate 41 having a thickness of a few millimeters up to a maximum of 2 to 3 cm. The plate 41 has two flat lateral surfaces 42 extending parallel to each other. The first cover part 40*a* is arranged in a plane that extends between the two lifting shafts 16, 17.

For the transmission of force, the connecting bar 31 is made of a buckle-resistant material exhibiting flexural strength, preferably of metal, for example steel, of carbon or of a stable composite material. The connecting bar 31 is disposed to move the half shaft 25 and must absorb the acceleration forces of the two lifting shafts 16, 17 and transmit them to the half shaft. As opposed to this, the cover part 40 is almost without force. In the preferred exemplary embodiment, the cover part 40 consists of a plastic or composite material having a thickness that is lower than that of the connecting bar 31. In the first cover part 40, the connecting bar 31 thus represents a core displaying flexural strength and being resistant to buckling, to which core the first cover part 40 having the form of a plate 41 is fastened.

Figure 5:
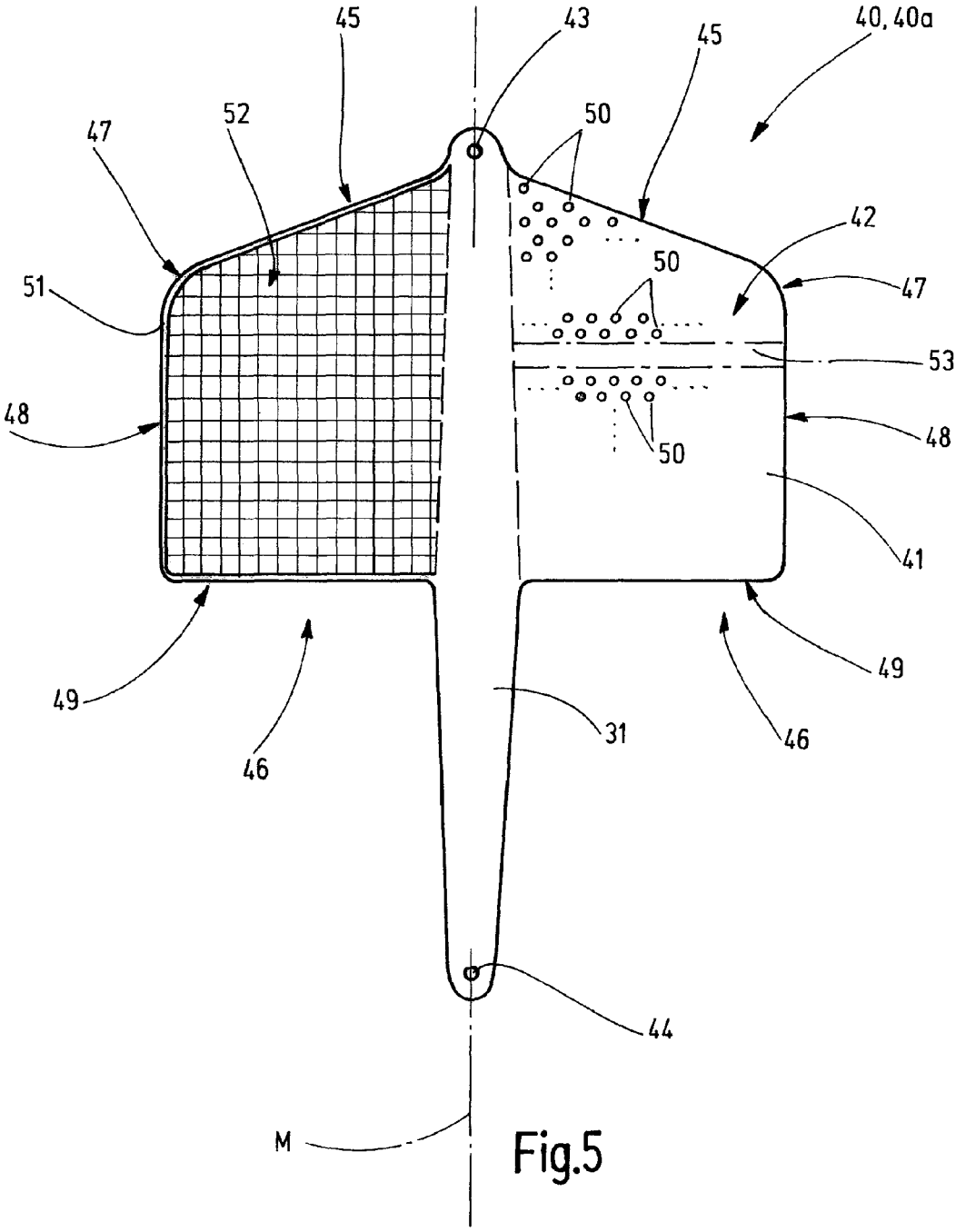
FIG. 5 a schematic representation of modified embodiments of the cover part as in FIG. 4.

The form of the connecting bar 41 in the case of the first cover part 40*a* can be learned from FIG. 5. On its upper end, the connecting bar 31 has a first hole 43 that is used for fastening the connecting bar 31 to the coupling joint 33. On its lower end, the connecting bar 31 has a second hole 44 that is used for the hinged connection of the connecting bar 31 with the half shaft 25 via the connecting bar joint 32. Relative to a center line M through the two holes 43, 44, the connecting bar 31 and the first cover part 40*a* are preferably arranged so as to be axis-symmetrical. Consequently, the first cover part 40*a* has two wings 46 that extend diametrically opposite away from the center line M and—viewed in the direction of the center line M—between the first hole 43 and the second hole 44. Starting from the end of the connecting bar 31 having the first hole 43, the upper edge 45 of each wing 46 extends diagonally, alternatively also perpendicularly, to the center line M in outward direction. The upper edge 45 transitions—via a curvature 47 that preferably extends along an arc of a circle—into an outer edge 48 of the wing 46, said edge essentially extending parallel to the center line M. On the end opposite the upper edge 45, the outer edge 48 transitions into a lower edge 49 that extends essentially radially with respect to the center line M in the exemplary embodiment. In the direction of the center line M, the distance of the second hole 44 from the lower edge 49 of the two wings 46 is at least half as great as the distance between the first hole 43 and the second hole 44. The distance of the lower edge 49 from the first hole 43 is at least half as great as the length of the two guide rods 34, 35, i.e., the distance between the shaft joint 36 and the coupling joint 33.

FIG. 5 shows schematic representations of additional modifications of the first cover part 40*a*. In one modification, the plate 41 may have a plurality of perforations 50 as has only been shown in an exemplary manner with reference to the right wing 46 in FIG. 5. The perforations may be arranged covering the entire surface of the first cover part 40*a* or they may be restricted to one or more regions, so that, for stabilizing the cover part, there also remain regions without perforations, i.e., the strips 53. The size or the contour of the perforations 50 is selected in such a manner that an operator cannot stick his finger through. The shape of the perforations 50 may be circular, slit-shaped, polygonal or have any other contour. As a result of these perforations 50 the weight of the plate 41 that must also be accelerated when the leno device 15 is being operated is reduced.

In another modification of the first cover plate 40*a*, said cover plate may have a frame 51 that completely encloses—by itself or together with the connecting bar 31—an opening in the first cover part 40*a*. Inserted in this opening is a grid-like and/or net-like and/or mesh-like insert 52 that completely fills the opening within the frame 51. The mesh-like openings present in the insert 52 are so small that an operator cannot reach through them with his finger. In this embodiment, the weight of the first cover part 40*a* can be further reduced. It is understood that the first cover part 40*a* may also have several openings with respectively one insert 52. A combination of perforations 50 and openings that are provided with an insert 52 is also possible. If a greater flexural strength of the first cover part 40*a* is necessary, the frame 51 may also be manufactured of the same material as the connecting bar 31. Furthermore, it is possible that at least one strip 53 or, in addition, at least one stiffening rip or a reinforcement element be provided in the plate 41 and/or between the frame 51 and the connecting bar 31. Such stiffening or reinforcement elements may be made of a material that is less resistant to bending and buckling than the remaining parts of the first cover part 40*a*.

A chain line in FIG. 4 schematically illustrates how the position of the first cover part 40*a* or the plate 41 changes when the two lifting shafts 16, 17 move relative to each other. In doing so, it can be seen that, due to the plate 41 fastened to the connecting bar 31, there is no intermediate space formed between the two guide rods 34, 35 and the connecting bar 31, through which intermediate space an operator could inadvertently reach.

Figure 6:
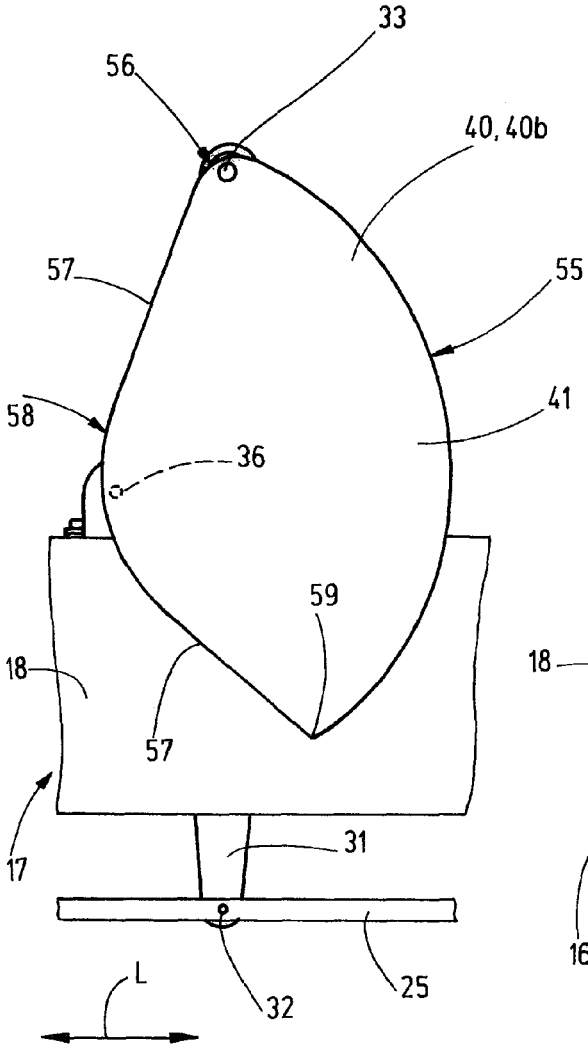
FIGS. 6 to 8 a schematic representation of another exemplary embodiment of a cover part for a leno device, said cover part being connected to a guide rod, viewed from different sides in warp thread direction.
Figure 7:
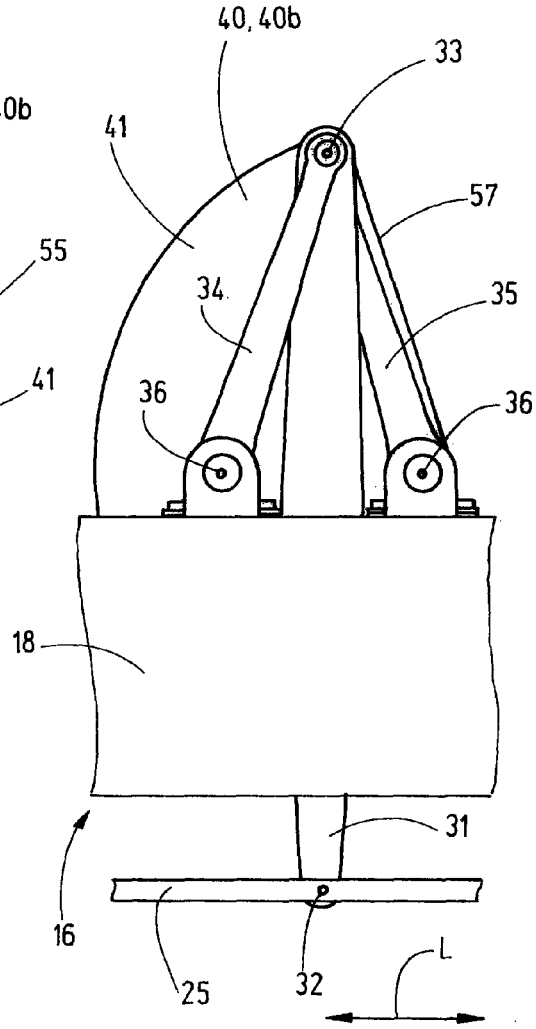
Figure 8:
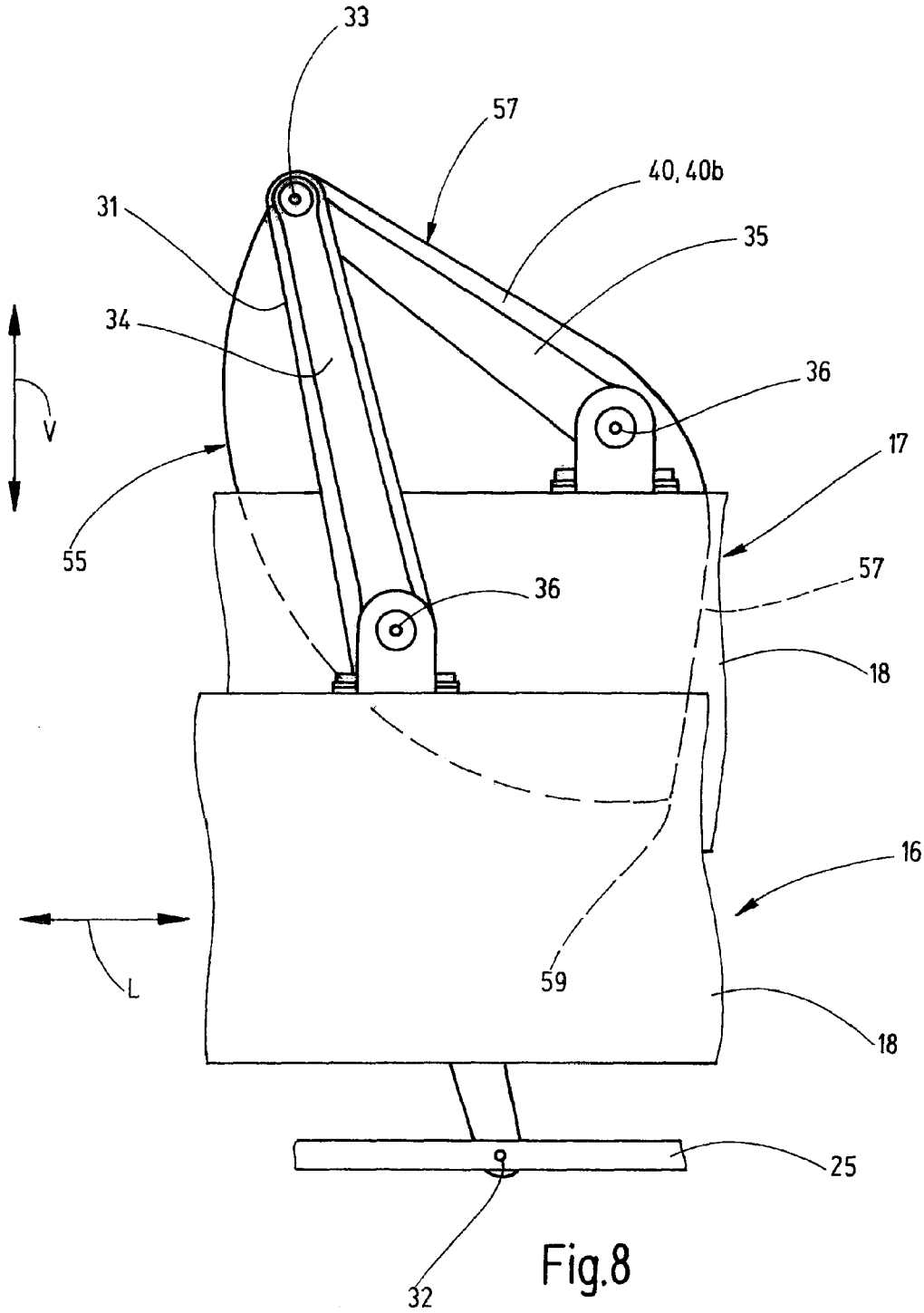

FIGS. 6 to 9 show a second cover part 40*b*. FIG. 6 is a representation—with a view on the second lifting shaft 17 upstream in warp thread direction K, whereas FIGS. 7 and 8 represent a view in opposite viewing direction. The second cover part 40*b* is also configured as a plate 41. Different from the first cover part 40*a*, the plate 41 of the second cover part 40*b* is non-torsionally connected to the second guide rod 35.

In doing so, the plate 41 has a contour that is similar to a sector of a circle. Thus, a lateral edge 55 extends along an arc of a circle whose center is located close to the shaft joint 36, via which the second guide rod 35 is connected to the upper shaft rod 18 of the second lifting shaft 17. The plate 41 of the second cover part 40*b* extends in a plane that—viewed in warp thread direction—extends upstream of the two lifting shafts 16, 17 and is defined by the vertical direction V and the direction of longitudinal extension L. In the region of the coupling joint 33, the lateral edge 55 transitions via a radius 56 into a straight edge 57 that extends in the direction toward the shaft joint 36. Another straight edge 57 extends from the end of the lateral edge 55 opposite the coupling joint 33 in the direction toward the shaft joint 36. The two straight edges 57 are connected with each other by a radially curved edge section 58. The transition between the straight edge 57 and the lateral edge 55 on the end opposite the coupling joint 33 is provided by a corner 59, as indicated in the example. At least the edge transitions pointing upward in vertical direction V are curved or formed over radii in order to minimize the risk of injury to the operator, as has also been schematically indicated by FIGS. 12 and 13.

Figure 9:
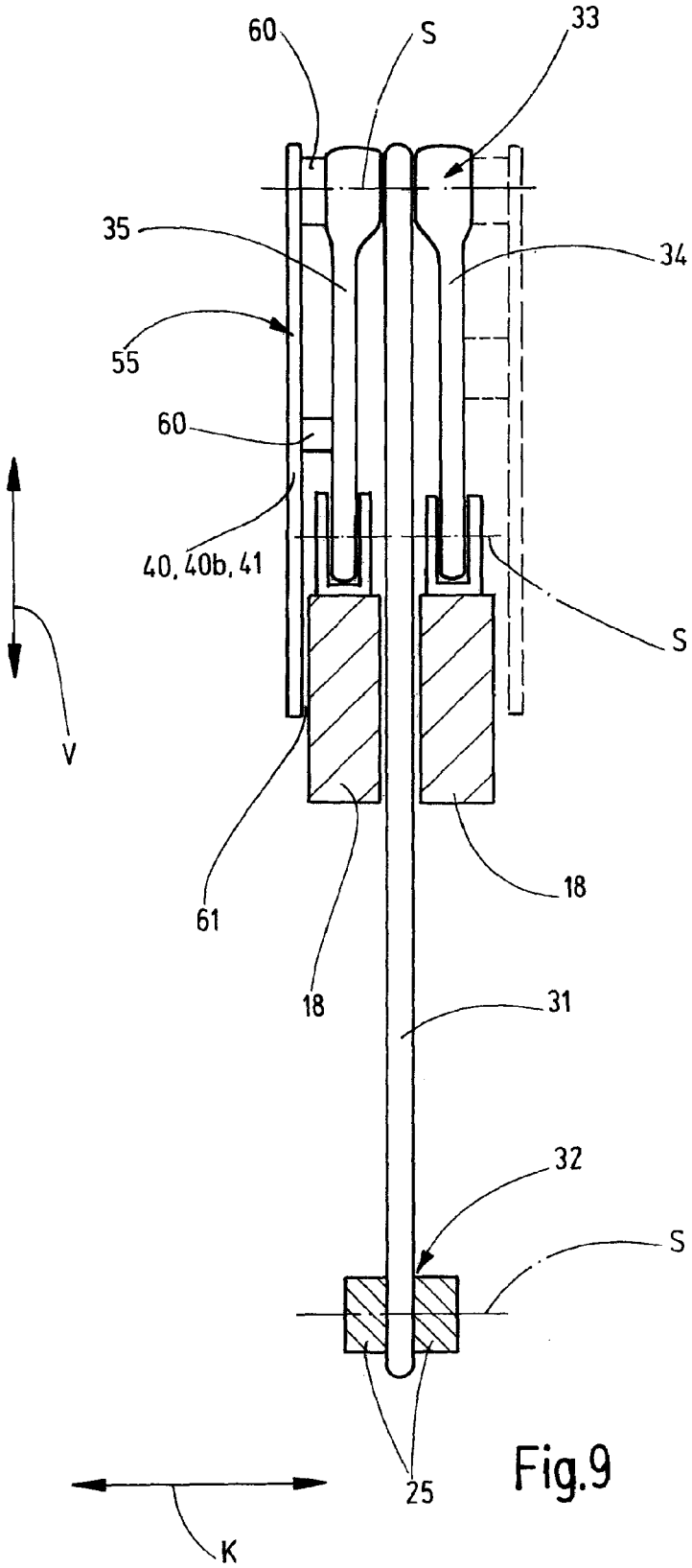
FIG. 9 a schematic sectional view, transverse to the direction of longitudinal extension of the lifting shafts, of the exemplary embodiment of the leno device having the cover part as in FIGS. 6 to 8.

FIG. 9 is a cross-sectional view transverse to the direction of longitudinal extension L. The second cover part 40*b* represented by the plate 11 is shown with a view on the lateral edge 55 extending along an arc of a circle. The connection between the second cover part 40*b* and the second guide rod 35 is accomplished, in accordance with the example, via two separators 60, said separators causing the second cover part 40*b* configured as the plate 41 and the upper shaft rod of the second lifting shaft 17 to be arranged at a distance from each other while forming a gap 61. These separators 60 may be a single or multi-piece component of the second cover part 40*b* and thus may be made without seams and joints of one uniform material together with the second cover part 40*b*. The separators 60 prevent the second cover part 40*b* from inadvertently coming into contact with the upper shaft rod 18 during operation of the leno device 15. Preferably, the second cover part 40*b* partially covers the upper shaft rod 18 of the second lifting shaft 17 in any position of the two lifting shafts 16, 17—viewed in warp thread direction K—so that the operator cannot pinch his hand between the upper shaft rod 18 and the second cover part 40*b*.

Furthermore, FIG. 9 shows that the pivot axes S of the coupling joint 33, the connecting bar 32 and the shaft joints 36 are aligned parallel to each other and, in accordance with the example, are oriented in warp thread direction K.

Figure 10:
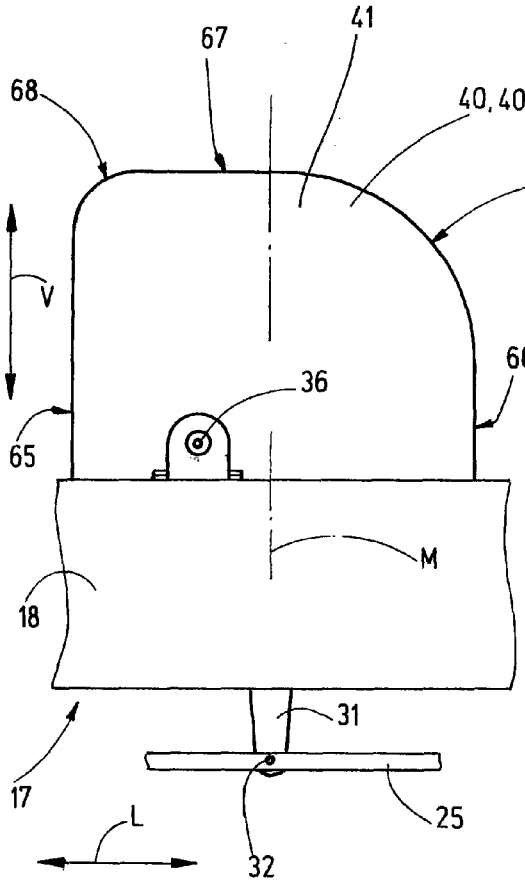
FIGS. 10 and 11 another exemplary embodiment of a cover part for a leno device, said cover part being connected to the shaft rod of a lifting shaft, in different viewing directions in warp thread direction.
Figure 11:
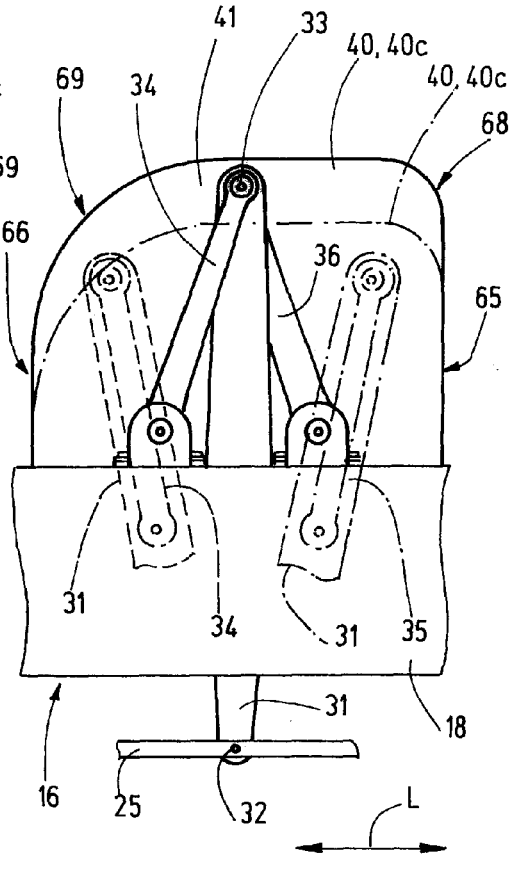

FIGS. 10 and 11 schematically show a third cover part 40*c*, again in the form of a plate 41. FIG. 10 is a representation with a view on the second lifting shaft 17 upstream in warp thread direction K, whereas FIG. 11 shows a view in opposite viewing direction. Different from the first two exemplary embodiments 40*a* and 40*b*, the third cover part 40*c* is rigidly connected with one of the upper shaft rods 18 and, for example, with the upper shaft rod 18 of the second lifting shaft 17. FIG. 10 is a representation with a view on the second lifting shaft 17, and FIG. 11 is a representation with the direction of view on the first lifting shaft 16. The plate 41 has an asymmetrical shape with respect to a center line M that extends—viewed in longitudinal direction of extension L—through the center of the plate 41. The plate 41 has a first edge 65 extending essentially in vertical direction V and a second edge 66 extending on the opposite side parallel thereto. Viewed in vertical direction V, the first edge 65 is longer than the second edge 66. An upper edge 67 of the plate 41 representing the third cover part 40*c* extends approximately in the direction of longitudinal extension L. The upper edge 67 is connected with the first edge 65 via a first transition radius 68 and with the second edge 66 via a second transition radius 69. The first transition radius 68 is smaller than the second transition radius 69.

Due to this asymmetrical shape of the plate 41 of the third cover part 40*c*, the surface of said plate is as small as possible. At the same time, it is ensured that the intermediate space between the connecting bar 31 and the two guide rods 34, 35 is completely covered in any position of the two lifting shafts 16, 17. The asymmetrical shape is necessary because the third cover part 40*c* is immovable in vertical direction V relative to the second lifting shaft 17, whereas the third cover part 40*c* performs a vertical movement relative to the first lifting shaft 16. The first edge 65 is arranged adjacent to the second guide rod 35, whereas the second edge 66 is arranged adjacent to the first guide rod 34.

The chain lines in FIG. 11 show the downward movement of the second lifting shaft 17 relative to the first lifting shaft 16, together with the third cover part 40*c*. The dashed lines in FIG. 11 show the position of the first guide rod 34 and of the connecting bar 31 when the first lifting shaft 16 moves vertically downward relative to the second lifting shaft 17. In doing so, the third cover part 40*c* remains in the position indicated in solid lines. In both cases it can be seen that the guide rods 34, 35, and a potential intermediate space Z between these guide rods 34, 35 and the connecting bar 31, is completely covered in all relative positions of the lifting shafts 16, 17 in warp thread direction K.

Figure 12:
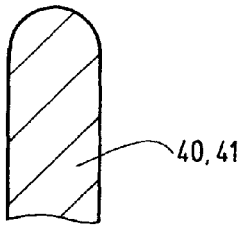
FIGS. 12 and 13 different embodiment options of the edges of the cover part.
Figure 13:
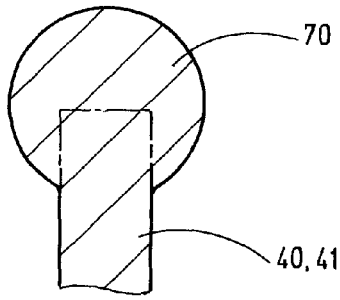

At least the edges pointing upward in vertical direction and/or the corners of the cover part 40 may be rounded in all the exemplary embodiments, as has been schematically illustrated in FIGS. 12 and 13. Referring to the exemplary embodiment as in FIG. 13, these edges are enlarged relative to the thickness of the plate 41, so that a thickened region 70 is formed. This thickened region 70, as it were, represents a protective guard against injury extending along the edge. The thickened region 70 may also be implemented as a separate, flexible element that is set on the edge of the plate 41, or glued or sprayed or otherwise material-bonded thereto, as is schematically indicated by the chain line in FIG. 13.

The embodiments of the plate explained in conjunction with the first cover part 40*a*, in particular the provision of perforations 50 and/or the provision of at least one opening comprising an insert 52, in the cover part 40, can be provided in all of the described exemplary embodiments. In particular, the first cover part 40*a* and the second cover part 40*b* may be fastened in a material-bonded manner to the connecting bar 31 or the guide bar 34 or 35, for example by means of a glued bond. It is also possible to manufacture the cover part 40*a*, 40*b* by injection molding and to directly adjoin the connecting bar 31 or the guide rod 34, 35 by molding during the injection molding process.

Viewed in the direction of longitudinal extension L, the length of the cover part 40 is greater than the distance between the two shaft joints 36—viewed in the direction of longitudinal extension L—in all exemplary embodiments. The height of the cover part 40 measured in vertical direction V on the coupling joint 33 when both lifting shafts 16, 17 assume the same vertical position is greater than the distance of the coupling joint 33 from the two lifting shafts 16, 17 in vertical direction V.

The present invention relates to a leno device 15 for use in weaving machines. The leno device 15 comprises a first lifting shaft 16, a second lifting shaft 17 and a half shaft 25. The shafts 16, 17, are connected with each other via a linkage mechanism 29 comprising several transmission units 30. Each transmission unit 30 comprises a connecting bar 31 and two guide rods 34, 35. In order to prevent fingers and or the hand of the operator from being pinched between the connecting bar and one of the levers 34, 35, the leno device 15 has a separate cover part 40 for each transmission unit 30. The cover part may be fastened to one of the lifting shafts 16 or 17, to one of the guide rods 34, 35 of the transmission unit 30, or to the connecting bar 31. The cover part 40 prevents an operator from being able to reach between the connecting bar 31 and the guide rods 34 and 35 in warp thread direction.

List of Reference Signs

15 Leno device
16 First lifting lever
17 Second lifting lever
18 Upper shaft rod
19 Lower shaft rod
20 Lateral support
21 Lifting heald
25 Half shaft
26 Half heald
29 Linkage mechanism
30 Transmission unit
31 Connecting bar
32 Connecting bar joint
33 Coupling joint
34 First guide rod
35 Second guide rod
36 Shaft joint
40 Cover part
40*a* First cover part
40*b* Second cover part
40*c* Third cover part
41 Plate
42 Lateral surface
43 First hole
44 Second hole
45 Upper edge
46 Wing
47 Curvature
48 Outer edge
49 Lower edge
50 Perforation
51 Frame
52 Insert
53 Strip
55 Lateral edge
56 Radius
57 Straight edge
58 Edge section
59 Corner
60 Separator
61 Gap
65 First Edge
66 Second edge
67 Upper edge
68 First transition radius
69 Second transition radius
70 Thickened region
F Area
K Warp thread direction
L Direction of longitudinal extension
M Center line
S Pivot axis
V Vertical direction
Z Intermediate space

What is claimed is:

1. Leno device (15) comprising a first lifting shaft (16) that is supported so as to be vertically shiftable and a second lifting shaft (17) that is supported so as to be vertically shiftable, each of said lifting shafts carrying lifting healds, and a half shaft (25) that is supported so as to be vertically shiftable relative to the lifting shafts (16, 17), said half shaft carrying half healds (26), and a linkage mechanism (29) that connects the half shaft (25) and at least one of the lifting shafts (16, 17) with each other for movement coupling, whereby the linkage mechanism (29) comprises a connecting bar (31) connected with the half shaft (25) on a connecting bar joint (32), and a guide rod (34, 35) connected with the connecting bar (31) on a coupling joint (33) and connected with the lifting shaft (25) on a shaft joint (36), and comprising a cover part (40) that covers the intermediate space (Z) that is opening and closing between the guide rod (34, 35) and the connecting bar (31) during operation of the leno device (15).

2. Leno device as in claim 1, characterized in that the connecting bar (31) is connected to the first lifting shaft (16) via a first guide rod (34) and to the second lifting shaft (17) via a second guide rod (35).

3. Leno device as in claim 1, characterized in that the cover part (40, 40*c*) is fastened to the shaft rod (18) of one of the two lifting shafts (16, 17).

4. Leno device as in claim 1, characterized in that the cover part (40, 40*c*) is configured so as to be asymmetrical relative to a center line (M).

5. Leno device as in claim 1, characterized in that the cover part (40, 40*b*) is non-torsionally connected to the guide rod (34, 35).

6. Leno device as in claim 1, characterized in that the cover part (40, 40*b*) has a shape resembling the sector of a circle.

7. Leno device as in claim 1, characterized in that the cover part (40, 40*a*) is fastened to the connecting bar (31).

8. Leno device as in claim 7, characterized in that the cover part (40, 40*a*) is connected to the connecting bar (31) in a material-bonded manner.

9. Leno device as in claim 1, characterized in that the cover part (40) consists of a plastic or composite material.

10. Leno device as in claim 1, characterized in that the cover part (40) is configured as a flat plate (41).

11. Leno device as in claim 1, characterized in that the cover part (40) has a plurality of perforations (50).

12. Leno device as in claim 1, characterized in that the cover part (40) has a net-like or mesh-like section (52).

13. Leno device as in claim 12, characterized in that the net-like or mesh-like section (52) consists of a woven or knit material.

* * * * *